United States Patent [19]

Long

[11] Patent Number: 5,061,519

[45] Date of Patent: Oct. 29, 1991

[54] PATTERNED GLUING APPARATUS AND METHOD

[76] Inventor: John A. Long, 41 Lamont Avenue, Scarborough, Ontario M1S 1A8, Canada

[21] Appl. No.: 404,983

[22] Filed: Sep. 11, 1989

[51] Int. Cl.[5] ..... B05D 5/10; B05C 5/02; B05C 11/00

[52] U.S. Cl. ..... 427/207.1; 427/286; 118/412; 118/669; 118/681; 118/682; 118/697; 222/509; 222/518

[58] Field of Search ..... 118/669, 681, 682, 697, 118/411, 412; 427/256, 286, 207.1; 222/509, 518

[56] References Cited

U.S. PATENT DOCUMENTS 3,068,838 12/1962 Gemelli ..... 118/411 X
3,190,259 6/1965 Craig et al. ..... 118/411 X
3,902,815 9/1975 Williams ..... 222/518 X
4,157,149 6/1979 Moen ..... 118/411 X

*Primary Examiner*—Evan Lawrence
*Attorney, Agent, or Firm*—Smart & Biggar

[57] ABSTRACT

A patterned gluing apparatus and method. The apparatus comprises a rotatable shaft supporting a plurality of glue nozzles arrangeable in different configurations about its periphery. The shaft has a hollow portion and holes communicating with the glue nozzles so that glue may be fed to the nozzles. The shaft is supported above an article conveyor so that the glue nozzles contact articles under the shaft as they are rotated past. The glue nozzles have depressable ball bearings closing off their tips so that they dispense glue on contact with an article. A controller monitors the position of the articles on the conveyor and controls rotation of the shaft so that lines and dots of glue are dispensed to programmed locations on the articles.

14 Claims, 2 Drawing Sheets

PATTERNED GLUING APPARATUS AND METHOD

Figure 1:
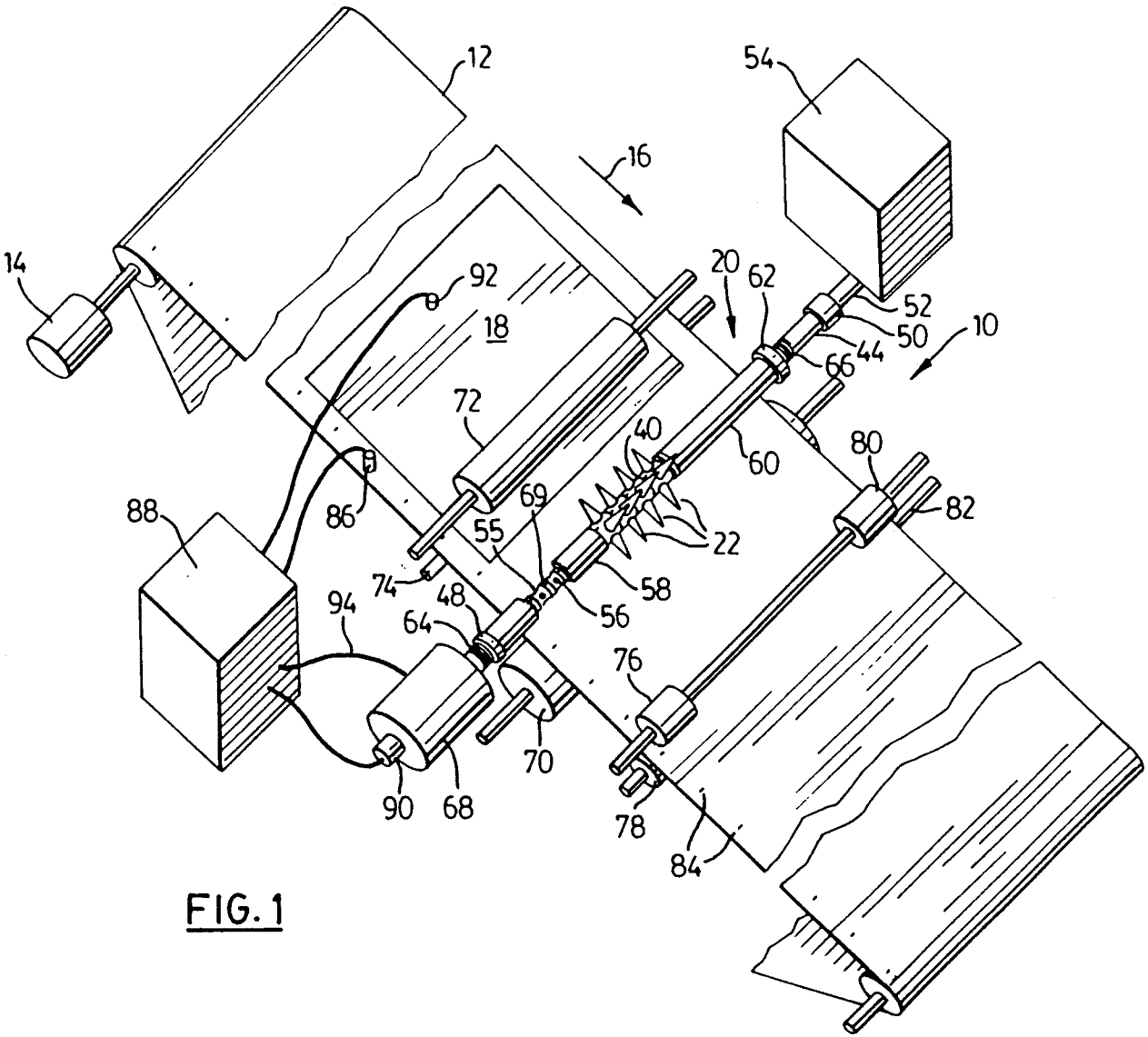

This invention relates to an apparatus and method for the patterned gluing of serially conveyed articles.

In the high speed handling of articles, it is known to form a glue pattern on substrate articles in preparation for affixing an article onto each substrate article. A glue pattern permits the secure fixing of the carried article no matter what its shape.

One known apparatus for patterned gluing comprises a drum having a circumference equal to the length of the substrate article. The drum is constructed to dispense glue in a particular pattern. A drawback with such an apparatus is that a new drum is required whenever the length of the substrate article changes or the pattern of the glue is to be changed. This results in significant tooling costs as well as downtime when it is necessary to replace a drum.

Accordingly, there is a need for a patterned gluing apparatus and method which avoids drawbacks of known apparatus and methods.

In accordance with the present invention there is provided an apparatus for dispensing glue onto an article in patterns comprising:

(a) article conveying means;

(b) glue dispensing means comprising an array of circulatable glue nozzles positioned so as to be circulatable into and out of contact with articles on said article conveying means, each of said glue nozzles adapted to dispense glue while in contact with an article, and rotatable shaft means for circulating said circulatable glue nozzles;

(c) drive means for rotating said rotatable shaft means; and (d) means to track the velocity of said article conveying means and the angular position of said shaft means and to control said drive means in response to the velocity of said article conveying means and the angular position of said shaft means in order to control the glue nozzles, whereby glue position of said array of circulatable nozzles may be selectively placed in contact with an article to be glued for a selected period of time in order to dispense dots or lines of glue onto said article.

In accordance with another aspect of the invention there is provided a method for dispensing glue onto an article in patterns comprising the following steps:

(a) conveying articles serially to a glue dispensing station; and (b) circulating an array of glue nozzles at said glue dispensing station, said glue nozzles of the type adapted to dispense glue upon contact with a surface, in response to the speed at which articles are conveyed so that selected glue nozzles come into contact with an article at said glue dispensing station for a selected period of time.

In accordance with yet another aspect of the invention there is provided a method for dispensing glue onto an article in patterns comprising the steps of:

(a) configuring a pattern of outwardly directed glue nozzles of the type adapted to dispense glue upon contact with a surface, about a rotatable shaft;

(b) conveying articles serially to adjacent said rotatable shaft; and (c) rotating said shaft in response to the speed at which articles are conveyed in order to circulate said glue nozzles so that selected glue nozzles come into contact with an article adjacent said rotatable shaft for a selected period of time.

In a further aspect, the invention comprises a device for the high speed selective dispensing of glue comprising:

(a) a ring having a plurality of side openings;

(b) a glue nozzle supported at its base in each of said side openings, each said glue nozzle comprising a housing with a basal opening and an apical opening containing a ball bearing urged by spring means to a rest position at which said ball bearing extends beyond the apical tip of said housing and closes off the apical opening of the housing.

Figure 2:
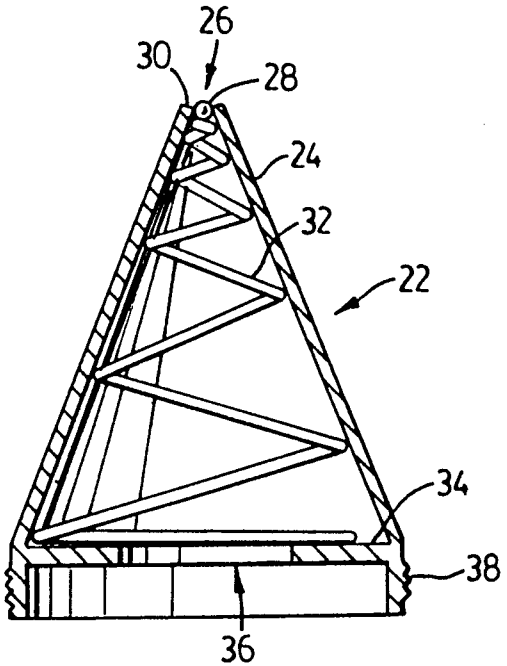
Figure 3:
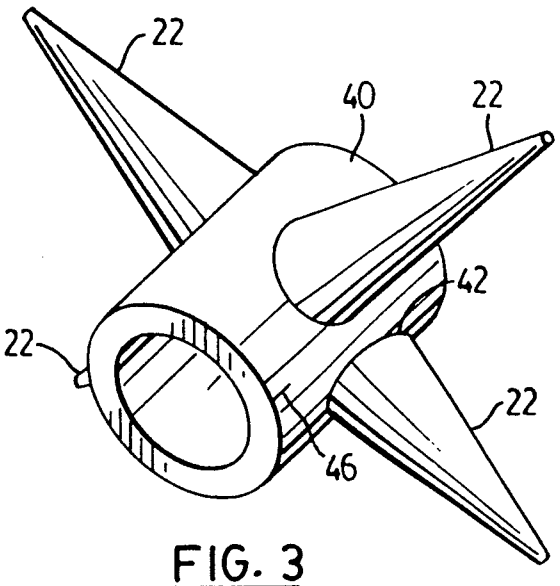
Figure 4:
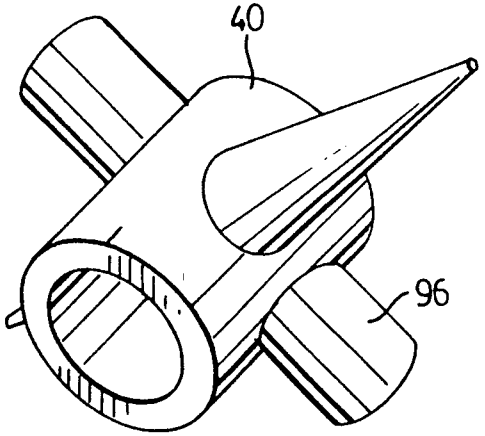

In the figures which illustrate example embodiments of the invention,

FIG. 1 is a partially cut away perspective view of an apparatus constructed in accordance with this invention, FIG. 2 is a cross-sectional view of a glue nozzle, FIG. 3 is a perspective view of a ring and glue nozzle construction made in accordance with this invention, and FIG. 4 is a perspective view of another ring and glue nozzle construction made in accordance with this invention.

Turning to FIG. 1, the apparatus for dispensing glue onto an article in patterns is illustrated generally at 10. Apparatus 10 has an article conveying means comprising endless conveyor belt 12 and conveyor drive 14 for circulating the conveyor belt in the forward feed direction illustrated at 16. Articles 18 may be fed to the conveyor belt 12 upstream of glue dispensing means 20 by conventional means. The glue dispensing means comprise glue nozzles 22. These glue nozzles are adapted to dispense glue while contacting a surface as will be apparent by reference to FIG. 2.

Turning to FIG. 2, it is seen glue nozzle 22 comprises a housing 24 with an apical opening 26. The apical opening contains a ball bearing 28 that is urged against the inner surfaces of the apical tip 30 of the housing by a tapered spring 32. In this rest position ball bearing 28 extends beyond the apical tip 30 of the housing 24 and closes off the apical opening 26. Spring 32 is supported at its base by a flange 34 of the housing. Flange 34 leaves a basal opening 36 in the housing 24 so that there is fluid communication in the housing 24 from the base of the housing through to the apical opening and ball bearing 28. It will thus be apparent that should the ball bearing 28 be depressed into the housing 24 against the urging of spring 32, such as by the ball bearing contacting a surface, there will be fluid communication through both ends of the housing 24 of the glue nozzle.

Housing 24 also comprises basal thread 38 for threading the glue nozzle into a supporting ring 40 as best seen by reference to FIG. 3. Ring 40 has four threaded side openings 42 spaced equally about its periphery. A glue nozzle 22 is threaded into each of these side openings. Ring 40 also has a registration mark 46 at its edge and directly between two glue nozzles; the purpose of the registration mark will become apparent hereinafter.

Returning to FIG. 1, four rings 40 carrying glue nozzles 22 are supported on rotatable shaft 44 over endless conveyor 12 at a height such that the ball bearing of each glue nozzle may contact any article 18 disposed directly under shaft 44. The shaft has a hollow segment extending from the end of the shaft which terminates in coupling 50, past the four rings 40 and ending proximate clamping nut 48. Coupling 50 couples the hollow segment of shaft 44 with tube 52 running from glue container 54. Coupling 50 allows shaft 44 to rotate therein. Shaft 44 has a series of reduced diameter sections 55 along the length of the hollow segment of the shaft each containing a side opening 56 which opens into the hollow segment of the shaft. Consequently, these openings to the hollow segment provide fluid communication between the hollow segment of the shaft and the interior of the rings 40. Glue container 54 gravity feeds glue through to the hollow segment of the shaft and to the rings 40 and the glue nozzles 22 associated therewith.

Shaft 44 also carries sheaths 58 and 60, one extending from either side of the four rings 40. These sheaths cover the openings 56 which are not disposed under the four rings 40. Clamping nuts 48 and 62 are threaded to threaded portions 64 and 66 of shaft 44 so that sheaths 58 and 60 press against either side of the four rings 40 in order to lock the four rings in position on the shaft 44. Drive 68 is connected to shaft 44 in order to rotate the shaft.

There is a registration mark 69 adjacent each reduced diameter section 55 of shaft 44 with which the registration mark 46 on each ring 40 may be aligned.

A support roller 70 supports the endless conveyor 12 directly under shaft 44. Due to support roller 70, when a glue nozzle is rotated to the endless conveyor 12, a firm contact is made between any article on the endless conveyor and the glue nozzle so that the ball bearing of the glue nozzle is depressed.

Glue guns 22, in contacting an article, will impart a drag to the article. To ensure that drag imparted by the glue nozzles does not displace the articles on the conveyor belt, pinch rollers 72 and 74 are provided upstream of the shaft 44 and pinch rollers 76 and 78 and 80 and 82 are provided downstream of shaft 44. In addition, a vacuum hold may be utilised along the conveyor belt.

Conveyor belt 12 has registration marks 84 along one edge. A photodetector 86 detects these registration marks and outputs detection signals to controller 88. The controller is programmed with the distance between the registration marks 84 so that it may track the speed of the conveyor belt 12 based on the signals from the photodetector.

Drive 68 has a potentiometer 90 associated therewith which provides signals to the controller 88 from which the angular position of the shaft 44 may be determined. Controller 88 also receives signals from edge detector 92 which detects the leading and trailing edges of articles 18. Controller 88 provides the supply voltage to drive 68 on line 94.

The number of rings 40 on shaft 44 may be changed by decoupling coupling 50 from shaft 44, unthreading and removing clamping nut 62 from the shaft and then sliding off sheath 60. Sheath 58 may be slid off the shaft after all of the rings 40 have been removed. If a greater number of rings are to be placed on the shaft, a shorter sheath 58 may be slid onto the shaft and into abutment with clamping nut 48 then the new, greater number of rings may be slid onto the shaft and a shorter sheath 60 may be slid into abutment with the last ring 40. The registration mark 46 on each ring 40 is aligned with registration marks 69 on the shaft 44 as hereinbefore noted. Lastly, the clamping nut 62 may be threaded onto thread 66 until the rings are locked between the two sheaths. Thread 64 allows clamping nut 48 to be repositioned so that the glue nozzles are accurately laterally positioned on the shaft 44. Coupling 50 is then recoupled to shaft 44.

For certain glue patterns, four nozzles per ring are inappropriate. If fewer glue nozzles per ring are desired, some of the glue nozzles may be unscrewed from the ring 40 and replaced with blind caps 96, as shown in FIG. 4. It is also possible to construct rings with more than the maximum of four nozzles per ring of the illustrated example embodiment.

The desired glue pattern indicates the needed number of rings and the nozzles per ring. By way of example, if a longitudinal glue line was required forward of and laterally spaced from a second glue line, then two rings having the configuration of the ring of FIG. 4 could be employed but with the position of their blind caps ninety degrees apart with respect to their registration marks 46. In this way, when the registration marks 46 of the two rings were aligned with the registration marks 69 of shaft 44, the rings would be oriented on shaft 44 with the caps of one laterally aligned with the nozzles of the other. As a result, when the nozzle of one ring contacted an article and a line of glue was dispensed as the article passed therebeneath, the other would present a non-dispensing cap to the article. By way of a further example, if four laterally aligned intermitent rows of glue dots or lines were desired, then four rings would be required each with the same number of nozzles and with the glue nozzles of adjacent rings laterally aligned; this is the configuration illustrated in FIG. 1.

The potentiometer 90 is calibrated so that it indicates a zero degrees angle of rotation of shaft 44 when the registration marks 69 of the shaft are directly opposite the conveyor belt 12. Consequently, with the registration marks 46 on the rings aligned with the registration marks 69 of shaft 44, at zero degrees of rotation, no glue nozzles are in a position whereat they would dispense glue to an article since the registration marks 46 of the rings are between the threaded openings 42 of the rings. This is the position at which shaft 44 is set by the controller during initialization on power-up.

The controller 88 is programmed with the needed angular position for the shaft when a notional line on an article (representative of a preset distance behind the leading edge of the article) is directly beneath shaft 44. In this way, gluing may be commenced a preset distance behind the leading edge of the article. In addition, the controller is programmed with the length of the glue line (or lines). The controller is also programmed with the arc during which gluing continues and so is able to rotate the shaft through this arc while a length of the article corresponding with the desired length of the glue line passes directly under the shaft 44. By way of explanation, the ball bearing of a glue nozzle will be depressed so that the nozzle will dispense glue when the nozzle passes through a small arc about the angular position at which it is directly opposite an article.

For example, say four laterally aligned glue lines of two centimeters length are to be positioned five centimeters behind the leading edge of each article on the conveyor belt 12. The patterned gluing apparatus will then be set up as shown in FIG. 1 and the controller 88 will be programmed to have rotated shaft 44 to the point where a laterally aligned set of glue guns begin to dispense glue when a notional line five centimeters behind the leading edge of an article is directly beneath shaft 44. The controller will be programmed to have rotated to the end of the arc in which this laterally aligned set of glue nozzles dispense glue when a notional line seven centimeters behind the leading edge of the article is reached.

In operation, conveyor drive circulates conveyor 12 and articles 18 are serially deposited to the conveyor belt by conventional means. It will be noted that the speed with which the conveyor belt is driven is not under the control of controller 88. Sensor 86 signals the controller when a conveyor belt registration mark 84 passes therebeneath. This allows the controller to constantly track the speed of the conveyor belt since the controller is programmed with the distance between the registration marks. When the leading edge of an article reaches sensor 92, a signal is sent to controller 88. From the foregoing information the controller tracks the progress of an article on the conveyor belt. Based on this information, the controller sends supply voltages of selected magnitude to drive 68 to control the speed of rotation of shaft 44. The controller controls the rotation of the shaft 44 so that the shaft is rotated to a programmed angle when the preset distance behind the leading edge of an article is directly beneath the shaft 44. For glue lines, it slows rotation of the shaft through the dispensing arc for any period necessary to achieve glue lines of programmed length. For glue dots, rotation through the dispensing arc may be sped up. For lengths of an article which are not to receive glue, the controller may stop shaft 44 at a non-dispensing position.

A conventional article dispenser is located downstream of the patterned gluing apparatus 10 which dispenses carried articles onto the substrate articles 18 at the site of the glue patterns. The glue bond may be enhanced by passing the composite substrate and carried articles through pinch rollers.

The embodiments in which an exclusive property or priviledge is claimed are defined as follows:

1. An apparatus for dispensing glue onto an article in patterns comprising:

(a) article conveying means;

(b) glue dispensing means comprising circulatable glue nozzles positioned so as to be circulatable into and out of contact with articles on said article conveying means, each of said glue nozzles adapted to dispense glue while in contact with an article, and rotatable shaft means for circulating said circulatable glue nozzles;

(c) drive means for rotating said rotatable shaft means; and (d) means to track the velocity of said article conveying means and the angular position of said shaft means and to control said drive means in response to the velocity of said article conveying means and the angular position of said shaft means, whereby glue nozzles may be selectively placed in contact with an article to be glued for a selected period of time in order to dispense dots or lines of glue onto said article.

2. The apparatus of claim 1 wherein said glue dispensing means comprises at least one ring with side openings to at least two glue nozzles spaced about its periphery and means to feed glue to the interior of said ring.

3. The apparatus of claim 2 wherein each of said glue nozzles comprises a housing with an apical opening containing a ball bearing urged by spring means to a rest position at which said ball bearing extends beyond the apical tip of said housing and closes off the apical opening of the housing.

4. The apparatus of claim 2 wherein said shaft means is rotatably mounted over said article conveying means, said shaft means supporting said at least one ring so that a glue nozzle of said at least one ring may contact an article on said article conveying means when rotated to said article conveying means, said shaft means having means to provide glue to said at least one ring.

5. The apparatus of claim 4 wherein said glue dispensing means further comprise a support roller supporting said article conveying means directly under said rotatable shaft means whereby when a glue nozzle is rotated to said article conveying means, said support roller ensures a firm contact between said glue nozzle and any article on said article conveying means under said rotatable shaft means.

6. The apparatus of claim 5 wherein said shaft means comprises a hollow segment extending from one end of said shaft means and wherein said shaft has a series of side openings along the length of said hollow segment of said shaft means which open to said hollow segment of said shaft means.

7. The apparatus of claim 6 wherein said shaft means carries two sheaths, one extending from either side of said at least one ring, said sheaths for covering said series of openings in the hollow segment of said shaft means which are not disposed under said at least one ring and wherein said shaft means further comprises clamping means for pressing said two sheaths against either side of said at least one ring in order to lock said at least one ring in position.

8. The apparatus of claim 7 wherein said shaft means comprises registration marks along the periphery of the hollow segment for allowing registration of said at least one ring.

9. The apparatus of claim 7 further comprising a glue dispenser coupled to the open end of the hollow segment of said shaft means.

10. The apparatus of claim 9 further including pinch roller means upstream and downstream of said shaft means for maintaining frictional contact between said article conveying means and articles conveyed by said article conveying means.

11. The apparatus of claim 10 wherein said velocity tracking means comprise registration marks along the periphery of said article conveying means and a photosensor and wherein said means to track the angular position of said shaft means comprise a potentiometer coupled to said shaft means and wherein said control means controls the voltage supply to said drive means in response to signals from said photosensor and said potentiometer.

12. A method for dispensing glue onto an article in patterns comprising the following steps:

(a) conveying articles serially to a glue dispensing station; and (b) circulating an array of glue nozzles at said glue dispensing station, said glue nozzles of the type adapted to dispense glue upon contact with a surface, in response to the speed at which articles are conveyed so that selected glue nozzles come into contact with an article at said glue dispensing station for a selected period of time.

13. A method for dispensing glue onto an article in patterns comprising the steps of:

(a) configuring a pattern of outwardly directed glue nozzles of the type adapted to dispense glue upon contact with a surface, about a rotatable shaft;

(b) conveying articles serially to adjacent said rotatable shaft; and (c) rotating said shaft in response to the speed at which articles are conveyed in order to circulate said glue nozzles so that selected glue nozzles come into contact with an article adjacent said rotatable shaft for a selected period of time.

14. A device for the high speed selective dispensing of glue comprising:

(a) a ring having a plurality of side openings;

(b) a glue nozzle supported at its base in each of said side openings, each said glue nozzle comprising a housing with a basal opening and an apical opening containing a ball bearing urged by spring means to a rest position at which said ball bearing extends beyond the apical tip of said housing and closes off the apical opening of the housing.

* * * * *